United States Patent [19]

Ishizu et al.

[11] Patent Number: 4,746,343

[45] Date of Patent: May 24, 1988

[54] METHOD AND APPARATUS FOR GAS SEPARATION

[75] Inventors: Takazumi Ishizu, Hikari; Masahiro Yamazaki, Kudamatsu; Shozi Koyama, Yamaguchi; Kazunori Nagae, Hikari; Junichi Hosokawa, Kudamatsu, all of Japan

[73] Assignee: Hitachi, Ltd., Tokyo, Japan

[21] Appl. No.: 924,771

[22] Filed: Oct. 30, 1986

[30] Foreign Application Priority Data

Oct. 30, 1985 [JP] Japan ..... 60-241402

[51] Int. Cl.[4] ..... F25J 3/06

[52] U.S. Cl. ..... 62/38; 62/18; 62/43

[58] Field of Search ..... 62/11, 17, 18, 22, 32, 62/36, 38, 42, 43, 44

[56] References Cited

U.S. PATENT DOCUMENTS

| | | | |
|---|---|---|---|
| 3,236,059 | 2/1966 | Bernstein | 62/18 X |
| 3,702,541 | 11/1972 | Randall et al. | 62/43 X |
| 3,967,464 | 7/1976 | Cormier et al. | 62/18 X |
| 4,202,678 | 5/1980 | Hvizdos | 62/38 |
| 4,453,956 | 6/1984 | Fabbri et al. | 62/18 |
| 4,604,116 | 8/1986 | Erickson | 62/22 X |

FOREIGN PATENT DOCUMENTS 60-23771 2/1985 Japan .

*Primary Examiner*—Steven E. Warner

*Attorney, Agent, or Firm*—Antonelli, Terry & Wands

[57] ABSTRACT

The invention discloses a method of gas separation which pressurizes part of a raw gas issuing from the outlet of an adsorbing tower by employing a compressor portion of an expander compressor, cools the pressurized gas by means of a main heat exchanger, and expands the cooled gas by means of an expansion turbine of the expander compressor, thereby efficiently carrying out gas separation with a simple arrangement.

23 Claims, 1 Drawing Sheet

METHOD AND APPARATUS FOR GAS SEPARATION

BACKGROUND OF THE INVENTION

The present invention relates to a method and an APPARATUS for gas separation after cooling a raw gas.

Gas-separation techniques for extracting product gas from a raw gas by cooling the gas and thereafter supplying the same to a gas separator section for rectifying separation or absorbing-separation process have been heretofore known. In particular, air separators for separating nitrogen, oxygen and argon etc., from air provided as a raw gas, which liquefy air and thereafter rectify the liquefied air, are now used in various fields.

Gas separators of this type necessitate compressing and expanding processes of a raw gas in accordance with operating conditions and, hence, require installations such as a compressor, an expansion turbine or the like. This type of separator in continuously operated for a long period of time in most cases, so that it is most important to consider how to reduce operation cost of, e.g., electric power consumption.

Many techniques have been developed for this theme. One known type of these techniques employs an expansion turbine with a compressor, namely, a combination of an expander and compressor which are directly coupled or interconnected through gears or the like (hereinafter referred to as an expander compressor) in order to efficiently generate a cold (refrigeration) in an air separator. A representative one of techniques of this type is disclosed in Japanese Patent Laid-Open No. 23771/1985. This technique first raises the temperature of gaseous air or nitrogen supplied from a lower column of a double rectifying column by making this gaseous stream pass through a reheat-cycle passage of a main heat exchanger and through a circulating heat exchanger installed separately from the main heat exchanger, pressurizes the heated gas with a compressor, makes it pass through the circulation heat exchanger so as to cool it, and thereafter introduces it into an expansion turbine, thereby providing a cold necessary for the air separator. This technique enables the cold necessary for the system to be generated with reduced gas flow rate through the expansion turbine. It is thereby possible to reduce the unit power consumption of the product gas.

In the arrangement of this technique, however, the gaseous air or nitrogen extracted from the lower column of the double rectifying column is directly supplied to the circulating heat exchanger, and a part of the same is supplied to the circulating heat exchanger through the reheat-cycle passage of the main heat exchanger for the purpose of temperature restoration, thus necessitating the circulating heat exchanger, so that the arrangement become complicated and the cost of installations is increased. Since the gas which is supplied to the compressor of the expander compressor flows through complicated passages of the circulating heat exchanger, the pressure loss and other energy losses caused therebetween are so large that the system cannot work effectively as desired. In addition, the temperature of the gaseous air or nitrogen extracted from the lower rectifying column is very low (about −170° C.), so that the difference between the temperature of this gas and that of the return gas in the circulating heat exchanger is large and, hence, the cold loss at the warm end of the circulating heat exchanger is large, even when the gas is warmed by mixing with its separated part whose temperature is raised through the reheat-cycle passage of the main heat exchanger.

SUMMARY OF THE INVENTION

It is an object of the present invention to provide a method and a system for gas separation in which a raw gas is divided into two flows at a stage before a main heat exchanger, one of these flows of raw gas being supplied to the warm-end side of the main heat exchanger so as to be cooled, and the cooled raw gas is then supplied to a gas separator section; the other flow of the raw gas is supplied to a compressor of an expander compressor so as to be pressurized, and the pressurized raw gas is then cooled to a temperature substantially equal to the warm-end temperature of the main heat exchanger and is thereafter supplied to the warm-end side of the main heat exchanger; and the pressurized gas which has been cooled by the main heat exchanger is supplied to an expansion turbine of the expander compressor, thus generating a cold.

DESCRIPTION OF THE PREFERRED EMBODIMENT

The present invention will be described hereunder in detail with respect to preferred embodiments thereof.

Figure 1:
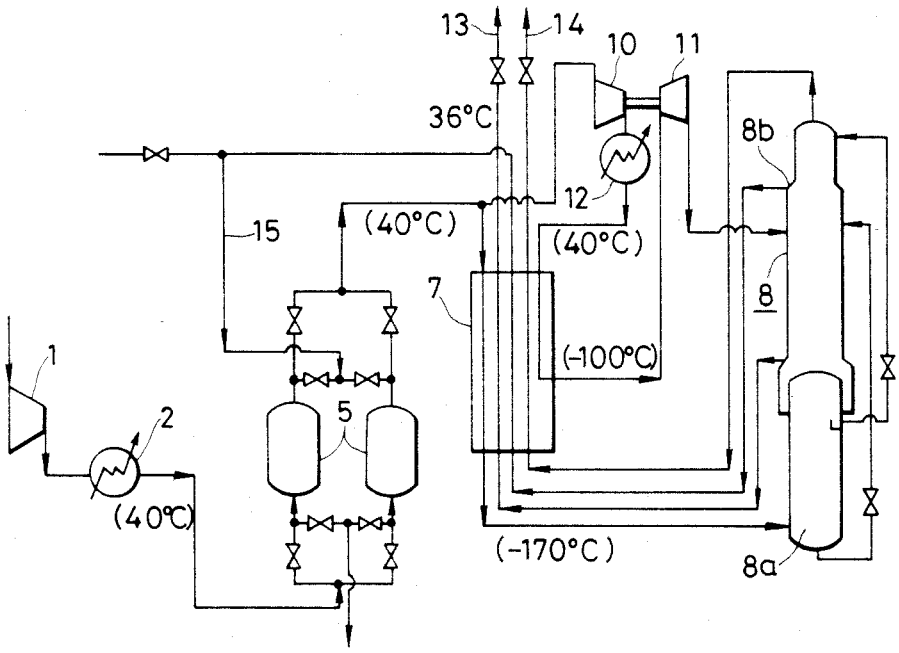
FIG. 1 is a system diagram of a gas separator which is one embodiment of the present invention.

FIG. 1 shows one example of the application of the present invention to an air separator which is most widely used for the purpose of extracting oxygen, nitrogen, or argon from air.

In this figure, an air compressor 1 for compressing air, an aftercooler 2, and a pair of pressure-difference swing adsorption towers 5 (hereinafter referred to as a PSA tower) are shown. The towers 5 are used alternately, being switched over at predetermined intervals. A main heat exchanger 7 cools a raw gas (air) by heat exchange with low-temperature return gas. In a double rectifying column 8, nitrogen and oxygen are separated from air and extracted as product nitrogen and product oxygen in the form of liquids or gases. A compressor 10 and an expansion turbine 11 are connected to each other by a shaft so as to constitute an expander compressor.

In this arrangement, air taken from the atmosphere is compressed to a pressure of about 5 kg/cm$^2$ G by the air compressor 1. The air heated by this compression is cooled by the aftercooler 2 down to about 40° C. and is thereafter introduced into the PSA tower 5 where water and carbon dioxide are adsorbed and removed to prevent the solidification of water ($H_2O$) and carbon dioxide ($CO_2$) in a downstream section of cryogenic separation which may cause problems such as the blockage of passages thereof. In this example, a PSA tower is used so that dry air is obtained at about 40° C. This dry air is regarded to be a raw gas in this embodiment. Other means for removing $H_2O$ and $CO_2$ may be employed in place of the PSA tower. For example, a temperature-difference swing adsorption tower filled with an adsorbent such as silica gel or a molecular sieve (hereinafter referred to as a TSA tower) can be used. When a TSA tower is used, the temperature of the material air at the outlet of the adsorption tower is about 8° C., so that the difference between this temperature and that of a gas (pressurized gas), which is obtained at the outlet of the aftercooler 12 after pressurization by the compressor of the expander compressor, to be described later, becomes so large that it causes cold loss due to the difference of temperatures at the warm-end of the main heat exchanger 7. For this reason, it is necessary to add a suitable device for cooling the pressurized gas before entering into the main heat exchanger 7.

The dry air thus obtained (raw gas) is divided into two flows at a stage before the main heat exchanger 7. One of these separated flows of air is cooled down to a temperature of about −170° C. by the main heat exchanger 7, and the thus-cooled air is led to a lower column 8*a* of the rectifying column 8. The other flow of air is introduced into the compressor 10 and is thereby pressurized to about 7 kg/cm$^2$ G, and the thus-obtained pressurized air is cooled down to about 40° C. by the aftercooler 12 and thereafter supplied to the warm-end side of the main heat exchanger 7. Both two flows of the material air are supplied to the warm-end side of the main heat exchanger 7 at about 40° C., namely, with no temperature difference therebetween, so that substantially no additional cold loss which could occur in circulating heat exchanger occurs. In addition, this method needs no circulating heat exchanger.

The pressurized gas which is introduced into the main heat exchanger 7 at 40° C. is extracted from an intermediate part of the main heat exchanger 7 where the temperature of the gas is about −100° C. It is thereafter supplied to the expansion turbine 11 and is expanded to about 0.4 kg/cm$^2$ G by adiabatic expansion so as to generate a cold. The compressor 10 is driven by the kinetic energy imparted to it by the expansion turbine 11. The cold gas, whose temperature has been reduced by generating the cold, is supplied to an upper column 8*b* of the rectifying column 8. The material air at about −170° C. supplied to the lower column 8*a* of the rectifying column 8 flows therethrough as an ascending gas and comes into contact with a reflux liquid obtained by condensation at the top of the lower column 8*a* so as to effect preliminary rectification, thereby providing liquid nitrogen (liquefied nitrogen gas) at the top of the lower column 8*a*. This reflux liquid becomes oxygen-rich liquid air ($O_2$ content: about 30 to 40%) at the bottom of the lower column 8*a*. The oxygen-rich liquid air which has undergone the preliminary rectification in the lower column 8*a* is introduced into an intermediate part of the upper column 8*b*. The liquid nitrogen extracted from the top of the lower column 8*a* is introduced to the top of the upper column 8*b*. As a result, product oxygen is obtained from the bottom of the upper column 8*b*, and product nitrogen is obtained from the top of the upper column 8*b*. These are supplied to the cold-end side of the main heat exchanger 7. The product oxygen and the product nitrogen, whose temperatures have recovered in the main heat exchanger 7, are extracted through conduits 13 and 14 respectively and are supplied to respective users. The waste gas extracted from the rectifying column 8 is released to the atmosphere after its temperature has been restored. A part of this waste gas is supplied through a conduit 15 to the absorption tower 5 where it is utilized for pressure swing reactivation.

Figure 2:
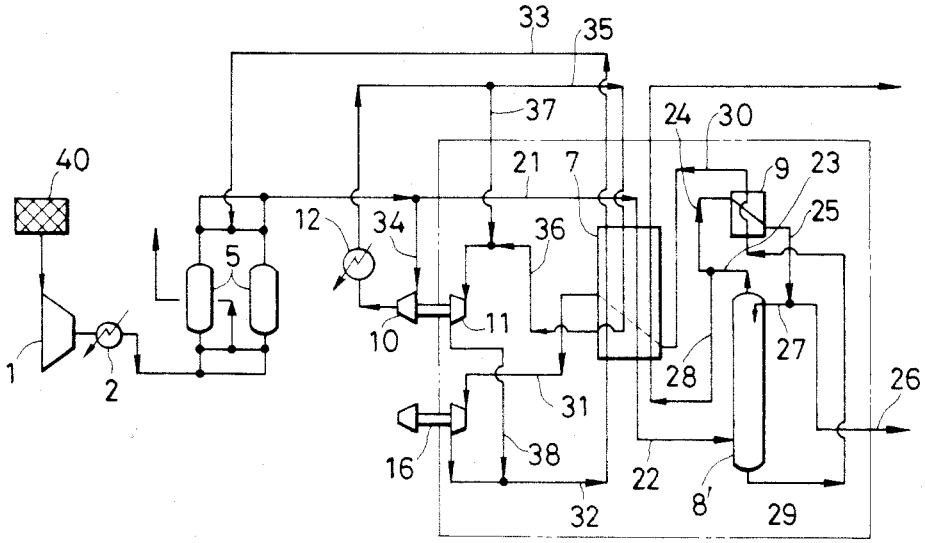
FIG. 2 is a system diagram of a gas separator which is another embodiment of the present invention.

Next, another embodiment of the present invention will be described with reference to FIG. 2, which shows an example of an arrangement in accordance with the present invention applied to a system for separating nitrogen from air. As shown in this figure, a material air is inhaled through a filter 40, pressurized by an air compressor 1 to a pressure of about 8 kg/cm$^2$ G, cooled by an aftercooler 2 to a normal temperature of about 40° C. and finally introduced into a PSA tower 5. The material air from which water and carbon dioxide are adsorbed and removed in PSA tower is divided into two flows at a stage before the main heat exchanger 7. One of these divided air flows of a quantity necessary for production of nitrogen by separation rectification is introduced through a conduit 21 into the main heat exchanger 7 and is cooled to about −170° C. by heat exchange with cold return gases. It is thereafter introduced into a rectifying column 8' through a conduit 22. In the rectifying column 8', the air is rectified and separated, and is extracted as nitrogen gas through a conduit 23 so as to be introduced to a nitrogen condenser 9. The nitrogen gas which has been cooled and liquefied in the nitrogen condenser 9 by a liquid air, which will be described later, is extracted in the form of a liquid nitrogen through a conduit 25. A part of this liquid nitrogen is taken out of the air separator as product liquid nitrogen through a conduit 26. The other part of the liquid nitrogen is supplied to the rectifying column 8' through a conduit 27 so that it is used as a reflux liquid. When in the column a part of the nitrogen gas is extracted as as product, it may be taken out under a pressure of about 7 to 7.2 kg/cm$^2$ G after it is supplied to the main heat exchanger 7 through a conduit 28 and its temperature is restored to the normal temperature (about 36° C.). The liquid air collected at the bottom of the rectifying column 8' is extracted through a conduit 29 and is led to the nitrogen condenser 9 after its pressure is reduced to about 3.5 kg/cm$^2$ G, so as to undergo heat exchange with nitrogen gas. The liquid air which has been vaporized in the nitrogen condenser 9 becomes a waste gas of an oxygen content of 32 to 36%, enters the main heat exchanger 7 through a conduit 30, and is then introduced into an expansion turbine 16. In the expansion turbine 16, the waste gas which has been expanded by adiabatic expansion from about 3.5 kg/cm$^2$ G to a substantial atmospheric pressure becomes low-temperature gas of −175° C. to −180° C. The cold waste gas is then led to the main heat exchanger 7 through a conduit 32, where it is recovered from the cold state so as to raise its temperature to the normal temperature. It is thereafter taken out of the air separator and is supplied to the PSA tower 5 through a conduit 33, where it is utilized as a reactivation gas, finally being released to the atmosphere.

On the other hand, the other one of the two flows of air which has been divided at the stage before the main heat exchanger 7 is introduced into the compressor 10 through a conduit 34, where the pressure of the air is raised to about 10 kg/cm$^2$ G, and is thereafter cooled by the after cooler 12 to a temperature substantially equal to that of the material air (about 40° C.). The air is then divided into two flows and led by two lines, namely, a line which supplies the air to the warm-end side of the main heat exchanger 7 and, after cooling thereof to about −160° C., takes it out through a conduit 36, and the other line which leads the air of the normal temperature to join it with a low-temperature air flowing through the conduit 36. The temperature of the air is adjusted to a suitable degree (−130° C. to 140° C.), and is led to the expansion turbine 11 of the expander compressor. The expansion turbine provides a cold by expanding the pressurized air in the manner of adiabatic expansion from about 9 kg/cm$^2$ G to the substantial atmospheric pressure, and the air which has issued from the expansion turbine 11 at a temperature of −175 to −180° C. is led by a conduit 38 so as to join with the waste gas which has issued from the expansion turbine 16, thus forming a cold generating cycle which leads the air to the main heat exchanger 7 through the conduit 32. The amount of cold generation per unit air flow rate is thereby increased.

This embodiment adopts PSA towers as an apparatus for preliminarily treating the air, thereby enabling the warm-end temperature difference of the main heat exchanger 7 to be minimized, without any additional equipment other than the water-cooling type aftercooler 12 at the outlet of the compressor 10.

With respect to the above-described embodiments, the invention has employed air as a raw gas, but the raw gases in accordance with the present invention may include raw gases to be purified such as a crude nitrogen gas, crude oxygen gas or crude argon gas, in addition to air and waste gas to be recovered, namely, mixed gases as raw gas from which product gases can be separated and extracted.

In the above-described embodiments, a rectifying-separation apparatus has exemplified the gas separator section, but the gas separator section in accordance with the present invention may be low-temperature absorption means using, e.g., a molecular sieve, in addition to the rectifying-separation means for effecting liquefying separation by employing a single or multiple rectifying column. Any means is possible as long as it can separate and extract a product gas.

In the embodiment described above in connection with FIG. 1, a cold gas generated by being expanded by the expansion turbine is supplied to the rectifying column, but, in order to recover the cold of cold gas this cold gas may be supplied partially or entirely to the coldend side of the main heat exchanger, directly or through a heat exchanger for recovering the cold of cold gas.

According to the present invention, as described above, gas-separation process can be effectively carried out with a simple arrangement, and, in particular, a sufficient cold can be obtained without any liquefying apparatuses or the like when a product gas is extracted in the form of liquid (liquefied gas), thus simplifying the facilities.

What is claimed is:

1. A method of gas separation comprising the steps of: after compressing a flow of raw gas and removing water and carbon dioxide therefrom, dividing the flow of compressed raw gas, having the water and carbon dioxide removed therefrom, into first and second flows at a stage before a main heat exchanger; supplying said first flow of gas to the warm-end side of said main heat exchanger so as to provide a cooled raw gas by means of a low temperature return gas; supplying said cooled raw gas to a gas separator section; supplying said second flow of gas to a compressor of an expander compressor so as to provide a pressurized gas; cooling said pressurized gas to a degree substantially equal to the warm-end temperature of said main heat exchanger, and thereafter supplying said pressurized gas to the warm-end side of said main heat exchanger; and supplying said pressurized gas cooled by said main heat exchanger to an expansion turbine of said expander compressor, thereby generating a cold.

2. A method of gas separation according to claim 1, wherein said gas separator section comprises a rectifying separation section.

3. A method of gas separation according to claim 1, wherein a cold gas after being expanded by said expansion turbine is supplied partially or entirely to the cold-end side of said main heat exchanger, directly or through a heat exchanger for recovering a cold of cold gas.

4. A method of gas separation according to claim 1, wherein said raw gas comprises air.

5. A method of gas separation according to claim 1, wherein water and carbon oxide are adsorbed removed from said raw gas by means of a pressure-difference swing adsorption tower.

6. An apparatus for separating gas comprising: a compressor for compressing a raw gas; and adsorbing tower for adsorbing and removing water and carbon dioxide contained in the compressed raw gas; a passage for dividing gas issuing from the outlet of said adsorbing tower, into first and second flows; a main heat exchanger; first conduit means for supplying said first flow of gas to the warm-end of the main heat exchanger; second conduit means for supplying a raw gas cooled by said main heat exchanger to a gas separator section; third conduit means for supplying said second flow of gas to a compressor of an expander compressor; fourth conduit means for supplying a pressurized gas issuing from the outlet of said compressor to the warm-end of said main heat exchanger; and fifth conduit means for supplying said pressurized gas to an expansion turbine of said expander compressor after said pressurized gas is cooled by said main heat exchanger.

7. An apparatus for separating gas according to claim 6, further comprising an aftercooler for cooling pressurized gas issuing from the outlet of said compressor and prior to the pressurized gas being supplied to the warm-end of the main heat exchanger, and wherein said fifth conduit means comprises a sixth conduit means for passing the pressurized gas from the outlet of the compressor to the inlet of said aftercooler and a seventh conduit means for passing the pressurized air from the outlet of the aftercooler to the warm-end of said main heat exchanger.

8. An apparatus for separating gas according to claim 6, wherein said adsorbing tower is a pressure-difference swing adsorption tower.

9. An apparatus for separating gas according to claim 6, further comprising eighth conduit means for passing part of a waste gas from the gas separator section to the adsorbing tower to reactivate the adsorbing tower.

10. An apparatus for separating gas according to claim 6, wherein said pressurized gas is extracted from an intermediate part of the main heat exchanger by said fifth conduit means.

11. An apparatus for separating gas according to claim 6, wherein said adsorbing tower is a temperature-difference swing adsorption tower.

12. An apparatus for separating gas according to claim 11, further comprising cooling means for cooling the pressurized gas issuing from the outlet of said compressor prior to said pressurized gas being supplied to the warm-end of said main heat exchanger.

13. An apparatus for separating gas comprising: a compressor for compressing a raw gas; an adsorber for adsorbing and removing water and carbon dioxide contained in the compressed raw gas; a compressor, of an expander compressor, for pressurizing part of the raw gas, the raw gas having been divided at an outlet of said adsorber into said part of the raw gas and a remaining part; an aftercooler for cooling pressurized gas issuing from an outlet of said compressor; a main heat exchanger for cooling the pressurized gas issuing from said aftercooler and for cooling the remaining part of the raw gas by a low temperature return gas from a gas separation section; and an expansion turbine, of said expander compressor, for expanding pressurized gas cooled by said main heat exchanger to generate a cold.

14. A method of gas separation comprising the steps of: dividing a flow of raw gas into first and second flows at a stage before a main heat exchanger; supplying said first flow of raw gas to the warm-end side of a main heat exchanger to cool said gas; supplying the cooled raw gas to a gas separation section; supplying said second flow of raw gas to a compressor to provide a pressurized gas; cooling said pressurized gas to a degree substantially equal to the warm-end temperature of said main heat exchanger and thereafter supplying it to the warm-end side of the main heat exchanger; supplying said pressurized gas cooled in said main heat exchanger to an expansion turbine to thereby generate a cold; and supplying a cold gas generated in said expansion turbine to said gas separation section.

15. A method of gas separation according to claim 14, wherein said flow of raw gas is a gas that has been compressed and has had water and carbon dioxide contained therein adsorbed and removed therefrom.

16. A method of gas separation according to claim 15, wherein said first flow of raw gas is supplied to the warm-end side of a main heat exchanger to cool the gas in the main heat exchanger by means of a low temperature return gas.

17. A method of gas separation according to claim 16, wherein said low temperature return gas is a gas returning from said gas separation section.

18. A method of gas separation according to claim 17, wherein said compressor and said expansion turbine form an expander compressor.

19. A method of gas separation comprising the steps of: dividing a flow of raw gas into first and second flows; supplying said first flow of raw gas to the warm-end side of a main heat exchanger to cool said gas; supplying the cooled raw gas to a lower column of a rectifying separation section; supplying said second flow of raw gas to a compressor to provide a pressurized gas; cooling said pressurized gas to a degree substantially equal to the warm-end temperature of said main heat exchanger and thereafter supplying it to the warm-end side of the main heat exchanger; supplying said pressurized gas cooled in said main heat exchanger to an expansion turbine to thereby generate a cold; and supplying a cold gas generated in said expansion turbine to an upper column of said rectifying separation section.

20. A method of gas separation according to claim 19, wherein said flow of raw gas is a gas that has been compressed and has had water and carbon dioxide contained therein adsorbed and removed therefrom.

21. A method of gas separation according to claim 20, wherein said first flow of raw gas is supplied to the warm-end side of a main heat exchanger to cool the gas in the main heat exchanger by means of a low temperature return gas.

22. A method of gas separation according to claim 21, wherein said low temperature return gas is a gas returning from said rectifying separation section.

23. A method of gas separation according to claim 22, wherein said compressor and said expansion turbine form an expander compressor.

* * * * *